US007845915B2

(12) United States Patent
Merz

(10) Patent No.: US 7,845,915 B2
(45) Date of Patent: Dec. 7, 2010

(54) ROTARY PUMP

(75) Inventor: Johann Merz, Schwacbisch Gmuend (DE)

(73) Assignee: ZF Lenksysteme GmbH, Schwaebisch Gmuend (DE)

( * ) Notice: Subject to any disclaimer, the term of this patent is extended or adjusted under 35 U.S.C. 154(b) by 32 days.

(21) Appl. No.: 12/012,916

(22) Filed: Feb. 5, 2008

(65) Prior Publication Data

US 2008/0170950 A1 Jul. 17, 2008

Related U.S. Application Data

(63) Continuation of application No. PCT/EP2006/063396, filed on Jun. 21, 2006.

(30) Foreign Application Priority Data

Sep. 1, 2005 (DE) ..... 10 2005 041388

(51) Int. Cl.
*F04C 28/22* (2006.01)

(52) U.S. Cl. ..... 417/220; 418/31

(58) Field of Classification Search ..... 417/220; 418/28, 30, 31

See application file for complete search history.

(56) References Cited

U.S. PATENT DOCUMENTS 6,155,797 A 12/2000 Kazuyoshi

2002/0192081 A1* 12/2002 Okada et al. ..... 417/213

FOREIGN PATENT DOCUMENTS

| | | |
|---|---|---|
| DE | 23 07 218 | 2/1974 |
| DE | 199 42 466 | 3/2000 |
| DE | 10 2004 020 603 | 12/2005 |
| JP | 56-143384 | 11/1981 |

* cited by examiner

*Primary Examiner*—Devon C Kramer
*Assistant Examiner*—Philip Stimpert
(74) *Attorney, Agent, or Firm*—Jordan and Hamburg LLP

(57) ABSTRACT

A rotary pump for producing a pressure medium flow for a consumer, includes a pump housing in which a curved ring is inserted. A rotor is rotatably borne on a drive shaft in the curved ring. The rotor carries displacement elements at a tangential distance to one another which form a pump chamber between the rotor and the curved ring with a suction opening. A pressure medium-activated adjusting device is operable for changing the eccentricity of the curved ring relative to the rotor, and includes a first pressure chamber and a second pressure chamber fluidically and tangentially distanced from the first pressure chamber The pressure in the first and second pressure chambers is controlled by a flow control valve, the low pressure chamber of which communicates with a first control line on a downstream side of a metering orifice. The first control line, as seen from the rotational direction of the rotor, opens at the beginning of the pressure opening such that a tangential pulse of the pressure medium is led to the metering orifice and a second control line opens at a secondary connector into the pressure opening such that a tangential and radial pulse of the pressure medium is led to a high pressure chamber of the flow control valve.

2 Claims, 1 Drawing Sheet

ROTARY PUMP

BACKGROUND OF THE INVENTION

The invention relates to a rotary pump for producing a pressure medium flow for a consumer. Rotary pumps for producing a pressure medium flow for a consumer that are adjustable in terms of their displacement volume or stroke are known (DE 199 42 466 A1). These rotary pumps have a curved or cam ring that is inserted into a pump housing and which is displaceably or pivotably borne therein. A rotor inserted in the curved ring is driven by a drive shaft and carries at a tangential distance to one another, displacement elements that move along, sliding or rolling on the interior surface of the curved ring. The rotor with the displacement elements can be arranged eccentric to the curved ring so that formed between the displacement elements and the interior surface of the curved ring are pump chambers that have a volume that increases and decreases. A suction opening for supplying fluid to a pump chamber is arranged opposing a pressure opening for removing from another pump chamber a fluid volume that is under pressure.

The curved ring is arranged in a recess of the pump housing and is positioned sealingly, but slidable or pivotable, therein against approximately opposing wall segments. Embodied between the exterior of the curved ring and the wall of the recess in the pump housing is a first pressure chamber and embodied approximately opposite thereto is a second pressure chamber, and these pressure chambers are fluidically separated from one another. The pressure chambers are components of a pressure medium-actuated adjusting device for the curved ring.

A flow control valve controls the pressure in the pressure chambers by adding or removing pressure medium. A low pressure chamber for the flow control valve is connected to a first control line leading from the pressure opening and that is on the downstream side of a metering orifice. A valve plunger actuated with a spring in the low pressure chamber controls the pressure medium actuation of the first and second pressure chambers in a manner known in and of itself.

Rotary pumps are known that have a metering orifice and that are additionally controlled directly or indirectly by the curved ring and which change their orifice cross-section as a function of the position of the curved ring in the pump housing.

The known control systems for a rotary pump are complicated and not optimized in terms of controlling behavior so that these rotary pumps can have increased power losses.

SUMMARY OF THE INVENTION

The underlying object of the invention is to create a rotary pump, the stroke of which can be adjusted in a simple manner and the power losses of which are minimized.

In accordance with the invention, the differential pressure at the metering orifice and the pulse of the pressure medium or fluid in the pressure opening of the rotary pump are used to displace the valve plunger of the flow control valve. For this, the first control line, which is simultaneously the pressure line for the rotary pump, opens in a primary connector that is arranged at the beginning of the pressure opening, as seen from the rotational direction of the rotor, and picks up a pressure medium pulse in the tangential direction of the rotor or the curved ring (a tangential pulse) and leads it to the metering orifice.

A second control line opens in a secondary connector into the pressure opening such that a tangential pulse and a pulse oriented in the radial direction of the rotor, curved ring, or pressure opening (a radial pulse) of the pressure medium is led to a high pressure chamber of the flow control valve.

The control behavior of the rotary pump is such that as the speed of the rotor increases, a falling flow rate is generated that is adapted to the power consumption of the consumer such that minimized power loss for the rotary pump results. A falling flow rate means a reduction in the displacement volume of the rotary pump as the speed of the rotor increases.

Surprisingly, it has been found that control behavior of the rotary pump that is particularly in line with the objective is attained in that the primary connector is arranged on the radially interior side of the pressure opening. It is particularly advantageous to arrange the primary connector approximately in the first third of the pressure opening with regard to the tangential extension of the pressure opening, as seen from the rotational direction of the rotor.

In order to attain exact, low-hysteresis control behavior of the rotary pump, it is furthermore advantageous to arrange the secondary connector of the second control line at the end of the pressure opening with regard to the tangential extension of the pressure opening, as seen from the rotational direction of the rotor.

Due to the inventive hydraulic cycle, it is not necessary for the cross-section of the metering orifice to be variable or controlled by the curved ring or the pressures in the first and second pressure chambers. The metering orifice cross-section can be kept rigid, which simplifies the structure of the rotary pump.

The pressure opening is embodied as a pressure kidney and the cross-sections of the primary connector and the secondary connector, as well as the first and second control lines, can be kept small, since only the pulse of the pressure medium therein is detected.

As the speed of the rotor increases, the pulse of the pressure medium in the second control line exceeds the pulse of the pressure medium in the first control line and in the low pressure chamber of the flow control valve so that the valve plunger of the flow control valve is displaced such that, due to the changed pressure ratios in the first and second pressure chambers, the eccentricity of the curved ring in the pump housing is reduced. The stroke of the rotary pump decreases and the flow rate of the rotary pump drops such that the power loss of the rotary pump is minimized. The rotary pump can thus be created without a separate cooling device.

In one particularly preferred exemplary embodiment, the rotary pump is formed as a vane cell pump with vanes for displacement elements and its first and second control lines preferably run in its pump housing. The vane cell pump is extremely well suited for supplying pressure medium of an actuator for a power-assisted or power steering system or of an actuator for an active undercarriage of a vehicle because its power consumption is minimized, as is its structural complexity.

One exemplary embodiment is depicted in the following in a drawing.

DETAILED DESCRIPTION OF THE INVENTION

Figure 1:
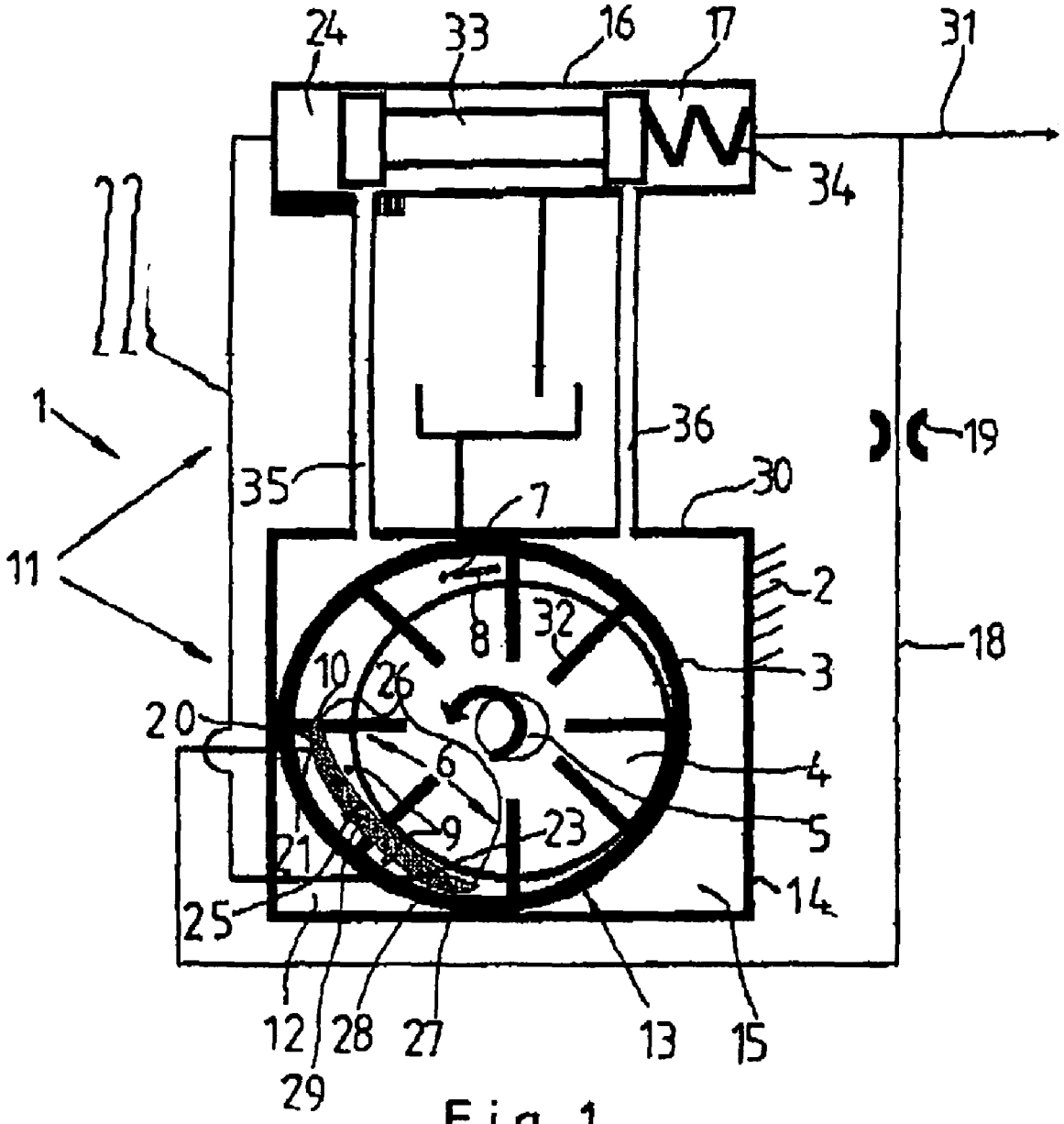
FIG. 1 depicts a schematic section through an inventive rotary pump.

FIG. 1 depicts a schematic cross-section of a rotary pump 1, embodied as a vane cell pump 30, that provides a flow of pressure medium to a pressure medium output 31 of a flow control valve 16. The vane cell pump 30 has a variable stroke and is suitable, in particular, as a feed unit in a power-assisted or power steering system for a vehicle. The vane cell pump 30 largely comprises a pump housing 2 in which a curved ring 3 is displaceably or pivotably arranged in a recess that is indicated by its walls 14. Arranged therein eccentric to the curved ring 3 is a rotor 4 that bears radially displaceable vanes 32 as displacement elements 6. The rotor 4 is driven by a drive shaft 5. The vanes 32 slide on the curved ring 3, positioned against the interior contour of the curved ring 3 by a hydraulic pressure.

Pump chambers 7, 9 having different volumes are formed between the vanes 32. Pressure medium from one pump chamber 7 with a large volume is densified from a suction opening 8 or a suction kidney to a pump chamber 9 that has a small volume and is drawn off via a pressure opening 10 of (embodied in the depicted example as a pressure kidney).

A pressure medium-actuated adjusting device 11 is provided in order to change the eccentricity of the rotor 4 and thus to change the pump quantity of the rotary pump 1. The adjusting device 11 is formed largely by a first pressure chamber 12, which is disposed between the exterior 13 of the curved ring 3 and the wall 14 of the recess in the pump housing 2, and a second pressure chamber 15 that is disposed approximately diametrical to the drive shaft 5 opposite the first pressure chamber 12 between the exterior 13 of the curved ring 3 and the wall 14.

The flow control valve 16 adjusts the feed rate of the pressure medium to a desired value. In the exemplary embodiment depicted, the flow control valve 16 is embodied with a valve plunger 33 that works as a pressure balance and that separates a high pressure chamber 24 from a low pressure chamber 17 and is arranged axially displaceable in a bore of the pump housing 2. The low pressure chamber 17 is fluid-connected to a first control line 18 that goes out from a primary connector 21 in the pressure opening downstream of a metering orifice 19. The control line 18 is simultaneously the pressure line of the rotary pump 1. A second control line 22 opens at or into the pressure opening 10 in a secondary connector 23 and connects the secondary connector 23 fluidically to the high pressure chamber 24 of the flow control valve 16. The valve plunger 33 is spring loaded by a spring 34 in the low pressure chamber 17 in the direction of the high pressure chamber 24.

As seen from the rotational direction of the rotor 4, the primary connector 21 opens at the beginning 20 in particular in the first third of the tangential extension 26 of the pressure opening 10 and on the radially interior side 25 of the pressure opening 10. The direction in which the primary connector 21 opens relative to the pressure medium flow in the pressure opening 10 that is embodied as the pressure kidney 29 is such that a pulse of the pressure medium in the tangential direction of the rotor 4 (a tangential pulse) can be drawn off into the first control line 18.

The direction in which the second control line 22 opens at the secondary connector 23 is such that a tangential and radial pulse of the pressure medium is diverted into the second control line 22. As depicted in FIG. 1, the secondary connector 23 is arranged on the end 27 of the pressure opening 10 on the radially exterior side 28 with regard to the tangential extension 26 of the pressure opening 10, as seen from the rotational direction of the rotor 4.

As the speed of the rotor 4 increases, the pulse of the pressure medium in the second control line 22 increases more relative to the pulse in the first control line 18 so that the pressure in the high pressure chamber 24 of the flow control valve 16 exceeds the pressure in the low pressure chamber 17 and the spring 34. The valve plunger 33 moves against the spring force of the spring 34 embodied as a compression spring and acts on the first and second pressure chambers 12, 15 via a third and fourth control line 35, 36 such that the curved ring gradually moves to the right in the sense of reducing the eccentricity of the rotor 4 and the stroke of the rotation pump 1.

The invention claimed is:

1. A rotary pump for producing a pressure medium flow for a consumer, comprising:

a pump housing;

a curved ring being inserted in said pump housing;

a drive shaft;

a rotor that is rotatably borne on the drive shaft being received in said curved ring;

displacement elements carried at a circumferential distance to one another on said rotor which, between said rotor and said curved ring, form a first pump chamber having a suction opening and a second pump chamber having a pressure opening;

a pressure medium-activated adjusting device for changing an eccentricity of said curved ring relative to said rotor, said pressure medium-activated adjusting device including a first pressure chamber between an exterior of said curved ring and a wall in said pump housing and a second chamber between said exterior of said curved ring and said wall, said second chamber being separated fluidically and circumferentially distanced from said first pressure chamber;

a flow control valve operable for controlling the pressure in said first and second pressure chambers;

a first control line leading from the pressure opening of the second pump chamber;

a metering orifice being disposed in said first control line, said flow control valve including a low pressure chamber which communicates with said first control line on a downstream side of the metering orifice, said first control line, as seen from a rotational direction of the rotor, opening at a beginning of said pressure opening in a primary connector into said pressure opening such that a circumferential pulse of the pressure medium is led to said metering orifice, said primary connector being disposed in a first third of said pressure opening with regard to a circumferential extension of said pressure opening, as seen from the rotational direction of said rotor; and a second control line opening at a secondary connector into said pressure opening such that another circumferential pulse and a radial pulse of the pressure medium is led to a high pressure chamber of said flow control valve.

2. A rotary pump according to claim 1, wherein said secondary connector of said second control line is arranged on an end of said pressure opening on a radially exterior side of said pressure opening with respect to said circumferential extension of said pressure opening, as seen from the rotational direction of said rotor.

* * * * *